US009052695B1

(12) United States Patent
Fedan

(10) Patent No.: US 9,052,695 B1
(45) Date of Patent: Jun. 9, 2015

(54) ALARM WRISTWATCH

(71) Applicant: Alexander Fedan, Herzliya (IL)

(72) Inventor: Alexander Fedan, Herzliya (IL)

( * ) Notice: Subject to any disclaimer, the term of this patent is extended or adjusted under 35 U.S.C. 154(b) by 0 days.

(21) Appl. No.: 14/542,601

(22) Filed: Nov. 16, 2014

(30) Foreign Application Priority Data

Dec. 23, 2013 (IL) ..... 230112

(51) Int. Cl.
*A44C 5/14* (2006.01)
*G04B 37/14* (2006.01)
*G04B 25/00* (2006.01)

(52) U.S. Cl.
CPC . *G04B 25/00* (2013.01); *A44C 5/14* (2013.01); *G04B 37/1486* (2013.01)

(58) Field of Classification Search
CPC ..... A44C 5/14; G04B 37/1486
USPC ..... 368/282; 24/365 WS
See application file for complete search history.

(56) References Cited

U.S. PATENT DOCUMENTS

| | | | | | |
|---|---|---|---|---|---|
| 1,219,449 | A * | 3/1917 | Fitch | 224/170 |
| 4,178,751 | A * | 12/1979 | Liautaud | 368/281 |
| 4,615,185 | A * | 10/1986 | Bollinger | 63/1.13 |
| 4,977,614 | A * | 12/1990 | Kurcbart | 455/193.1 |
| 5,179,733 | A * | 1/1993 | Matsui | 455/344 |
| 8,029,185 | B2 * | 10/2011 | Faucher et al. | 368/282 |
| 8,424,716 | B2 * | 4/2013 | Hegan et al. | 221/13 |
| 2003/0182770 | A1 * | 10/2003 | Koshoji | 24/265 WS |
| 2011/0099771 | A1 * | 5/2011 | Grossenbacher et al. | 24/265 R |

* cited by examiner

*Primary Examiner* — Sean Kayes
(74) *Attorney, Agent, or Firm* — Daniel J. Swirsky; AlphaPatent Associates Ltd.

(57) ABSTRACT

An alarm wristwatch including a watch, a strap having an extent, a mechanism for increasing and decreasing the extent of the strap, and a circuitry for controlling the mechanism to intermittently increase and decrease the extent of the strap, thereby increasing and decreasing a pressure of the strap on a user's wrist, resulting in attracting the user's attention, while not attracting other persons' attention.

20 Claims, 10 Drawing Sheets

ALARM WRISTWATCH

CROSS-REFERENCE TO RELATED APPLICATIONS

This application claims priority from Israel Patent Application No. 230,112, filed Dec. 23, 2013, the contents of which are incorporated herein by reference in their entirety.

TECHNICAL FIELD

The invention relates to the field of wristwatches. More particularly, the invention relates to an alarm wristwatch.

BACKGROUND

Alarm wristwatches have been in use for decades. The common ways to alert a person using a wristwatch include playing sounds, vibration, and even electric pulses.

Vibrating the watch is effective for wristwatches as they are in contact with the user's hand. However, a vibration is not always noticeable, and some people do not like to be waked up by a vibration.

As per alarm sound, in order to produce an alarm that wakes up a user is required a sound system that can produce "loud" signals, which creates technical difficulties when implemented in a "small" device such as a wristwatch. Furthermore, using a sound alarm may wake up other people.

Vibration as well is noticed by the public around, and as well is regarded as a nuisance or even forbidden at certain environments.

All the methods described above have not yet provided satisfactory solutions to the problem of alarm wristwatches.

It is an object of the invention to provide a solution to the above-mentioned and other problems of the prior art.

Other objects and advantages of the invention will become apparent as the description proceeds.

SUMMARY

In one aspect, the invention is directed to an alarm wristwatch, including:

a watch;

a strap having an extent;

a mechanism for increasing and decreasing the extent of the strap; and a circuitry for controlling the mechanism to intermittently increase and decrease the extent of the strap, thereby increasing and decreasing a pressure of the strap on a user's wrist, resulting in attracting the user's attention, while not attracting other persons' attention.

The mechanism may include:

a cogged area of the strap;

a cogwheel, correspondingly with the cogged area; and an electric motor, controlled by the circuitry, for rotating the cogwheel in one direction, thereby increasing the extent, and rotating the cogwheel in an opposite direction, thereby decreasing the extent.

The mechanism may include:

a conduit disposed along the strap;

a non-elastic wire disposed in the conduit; and a pulley wherein the wire is wrapped around, the pulley being controlled by the circuitry, for rotating the cogwheel in one direction, thereby increasing the extent, and rotating the cogwheel in an opposite direction, thereby decreasing the extent;

wherein the strap is characterized in allowing increasing and decreasing of the extent thereof.

The strap may include a first and a second segment.

The first and second segments of the strap are preferably connected one to the other at the overlapping length thereof, thereby the increasing and decreasing of the extent of the strap may increase and decrease both of the segments together.

The connection of the first and second segments of the strap one to the other at the overlapping length thereof may include:

a first hook being located at an end of the first segment, for being inserted into a hole of the second segment; and a second hook being located at an end of the second segment, for being inserted into a hole of the first segment.

The connection of the first and second segments of the strap one to the other at the overlapping length thereof may include a hook and loop fastener.

The alarm wristwatch may further include an external device, in communication with the watch.

The alarm wristwatch may further include an external device, in communication with the watch, for stopping an alarm of the wristwatch.

The alarm wristwatch may further include an external device, in communication with the wristwatch, for providing a user interface for setting the wristwatch.

The setting may be one or more of: a time, an alarming schedule, a display format of the wristwatch, and so on.

The external device may be a smartphone.

The external device may be a computer.

The external device may be a dedicated device.

The circuitry may be adapted to gradually intense a rhythm of the decreasing and increasing.

The control circuitry may be electronic.

The control circuitry may be computerized.

The increasing and decreasing of the extent of the strap may be carried out at one end of the strap.

The increasing and decreasing of the extent of the strap may be carried out at both ends of the strap.

The mechanism may include:

two rigid segments of the strap, pivotally connected to the watch;

each segment having a cogged area at the end thereof, in a form of a cogwheel;

each segment having a cogwheel, correspondingly with the cogged areas; and an electric motor, controlled by the circuitry, for generating an alarm by oppositely rotating the cogwheels in one direction, thereby drawing away the segments from each other, and rotating the cogwheels in an opposite direction, thereby approaching the segments to each other.

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

BRIEF DESCRIPTION OF THE DRAWINGS

Embodiments, features, aspects and advantages of the invention are described herein in conjunction with the following drawings.

It should be understood that the drawings are not necessarily drawn to scale.

DETAILED DESCRIPTION

The invention will be understood from the following detailed description of various embodiments thereof, which are meant to be descriptive and not limiting. For the sake of brevity, some well-known features, methods, systems, procedures, components, circuits, and so on, are not described in detail.

Figure 1:
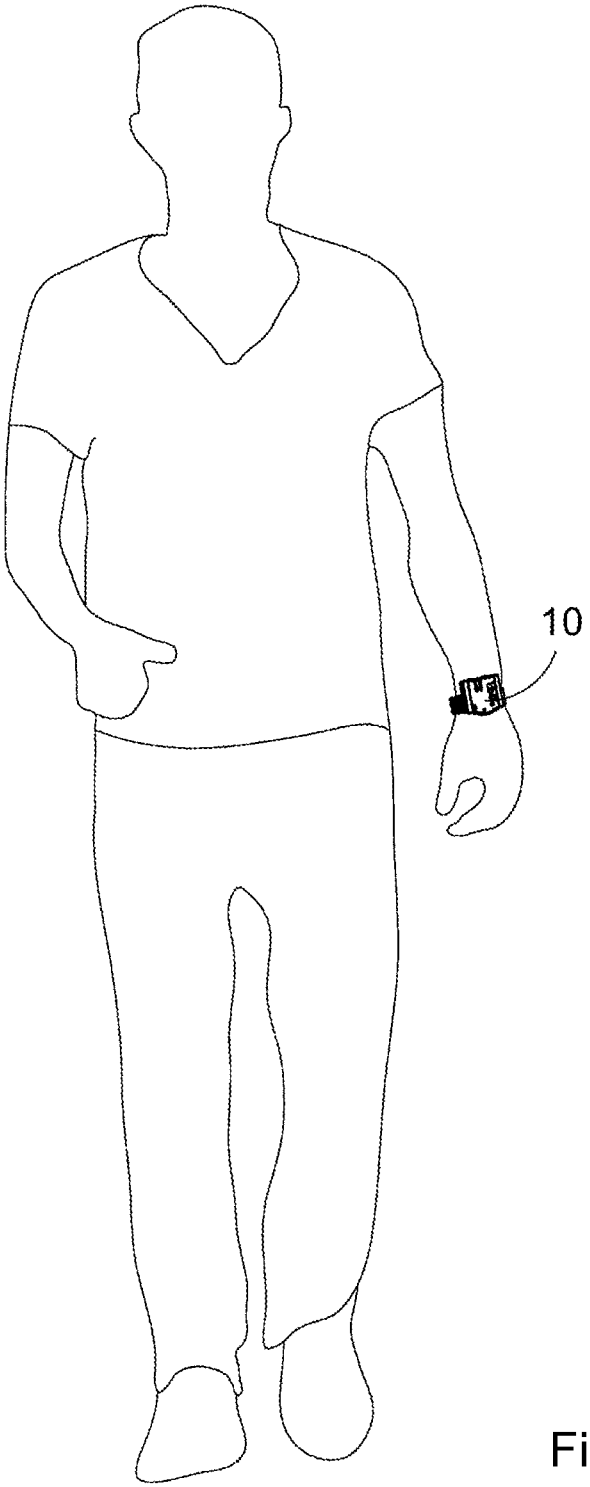
FIG. 1 schematically illustrates a user, wearing an alarm wristwatch, according to one embodiment of the invention.

FIG. 1 schematically illustrates a user, wearing an alarm wristwatch, according to one embodiment of the invention.

The alarm wristwatch is marked by reference numeral 10. As illustrated, the dimensions of wristwatch 10 are common in this field.

The wristwatch 10 comprises an alarming mechanism which attracts the user's attention by intermittently increasing and decreasing the extent of the strap of the wristwatch.

In contrast to vibration, the increasing and decreasing of the extent of the strap of the wristwatch is noticed only by the person wearing the wristwatch, and is not at all noticed by any other person, thus it cannot be regarded as a nuisance or forbidden at any environment.

The rhythm of increasing and decreasing the extent of the strap can be increased gradually, thereby waking a user in a less annoying form than other ways for this purpose, such as vibrations and sound.

Figure 2:
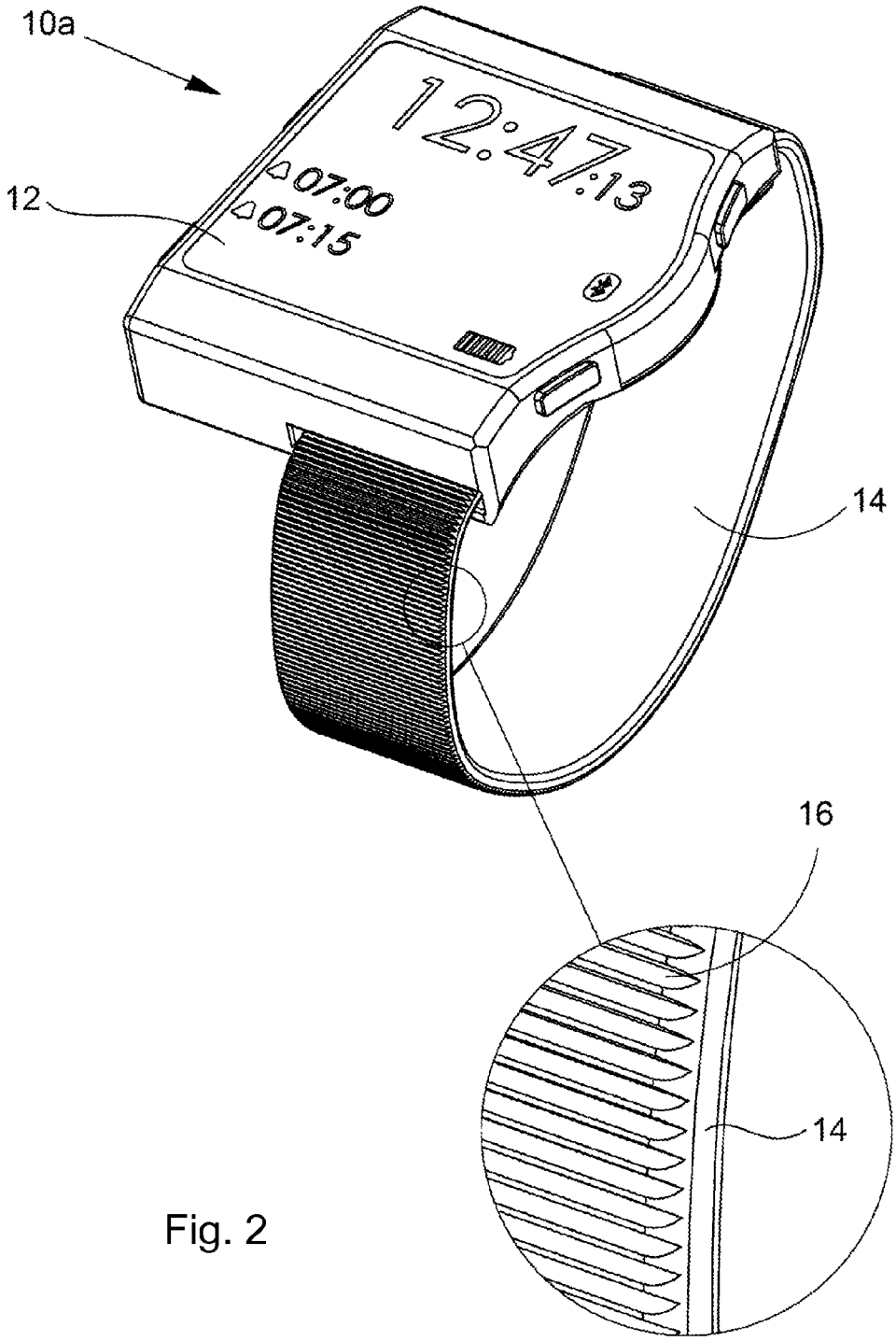
FIG. 2 schematically illustrates an alarm wristwatch, according to one embodiment of the invention.

FIG. 2 schematically illustrates an alarm wristwatch, according to one embodiment of the invention.

The wristwatch of this embodiment of the invention is marked herein by reference numeral 10*a*.

The wrist watch comprises a watch (mechanism and user interface) 12, and a strap 14 and a mechanism for changing the extent of strap 14. In order to wake up a user, this mechanism decreases and increases intermittently the extent of strap 14. As the extent of the strap decreases, it fastens the user's wrist, thereby waking him up.

Preferably, the rhythm of decreasing/increasing the extent of the strap and the applied fastening force are controllable by the control system of the watch. The control system may be electronic, computerized (i.e., employs a CPU and memory), and so on.

In the zoomed view it can be seen that strap 14 comprises a cogged area 16.

Figure 3:
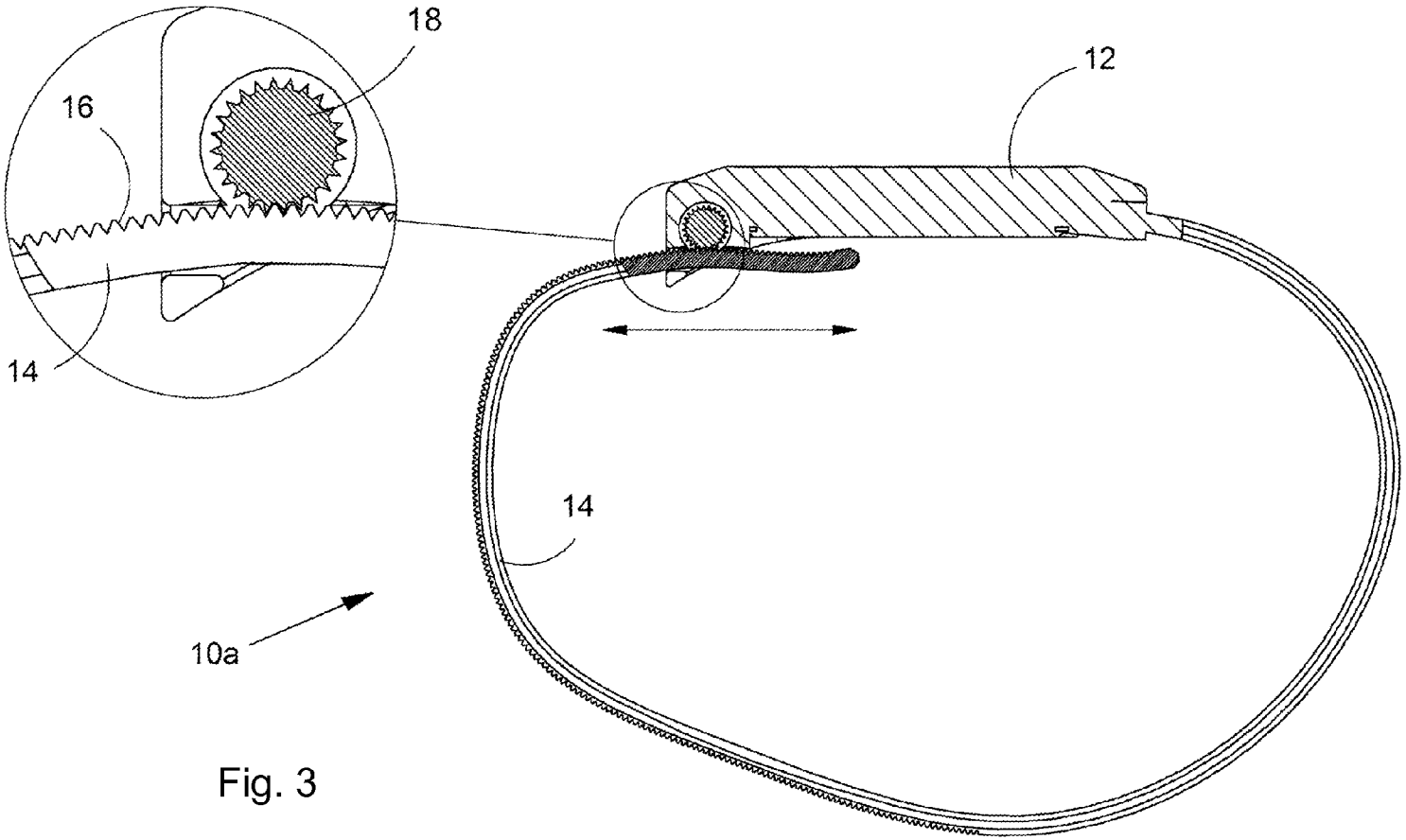
FIG. 3 is a sectional view of the alarm wristwatch of FIG. 2, which demonstrates the mechanism for changing the extent of strap 14.

FIG. 3 is a sectional view of the alarm wristwatch of FIG. 2, which demonstrates the mechanism for changing the extent of strap 14.

As mentioned, strap 14 comprises a cogged area 16, at least at a certain portion at one end thereof. Correspondingly, watch 12 comprises a cogwheel 18 (better seen in the zoomed view). Thus, by rotating cogwheel 18 in one direction, the extent of strap 14 increases, and by rotating the cogwheel in the opposite direction, the extent of the strap decreases.

Figure 4:
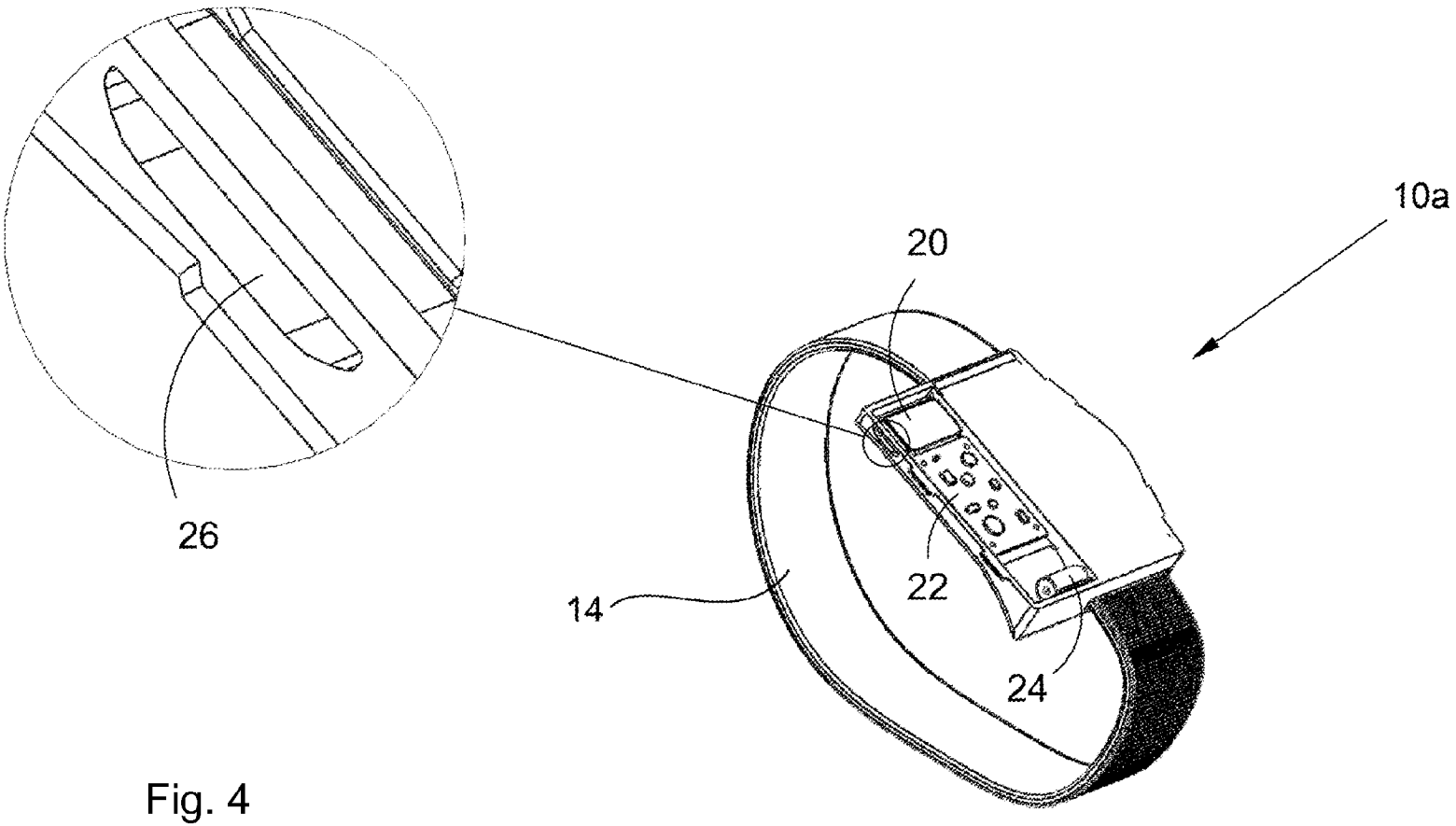
FIG. 4 is a broken view of the wristwatch of FIGS. 2 and 3.

FIG. 4 is a broken view of the wristwatch of FIGS. 2 and 3.

The broken view shows a control circuitry 22, which controls the operation of changing the extent of strap 14. Motor 24 rotates a cogwheel (not seen in this figure). The control circuitry and motor are operated by electric power provided by chargeable battery 20. In the zoomed view is seen a plug for providing electric power for charging the chargeable battery 20.

Reference numeral 26 denotes a USB connector.

Figure 5:
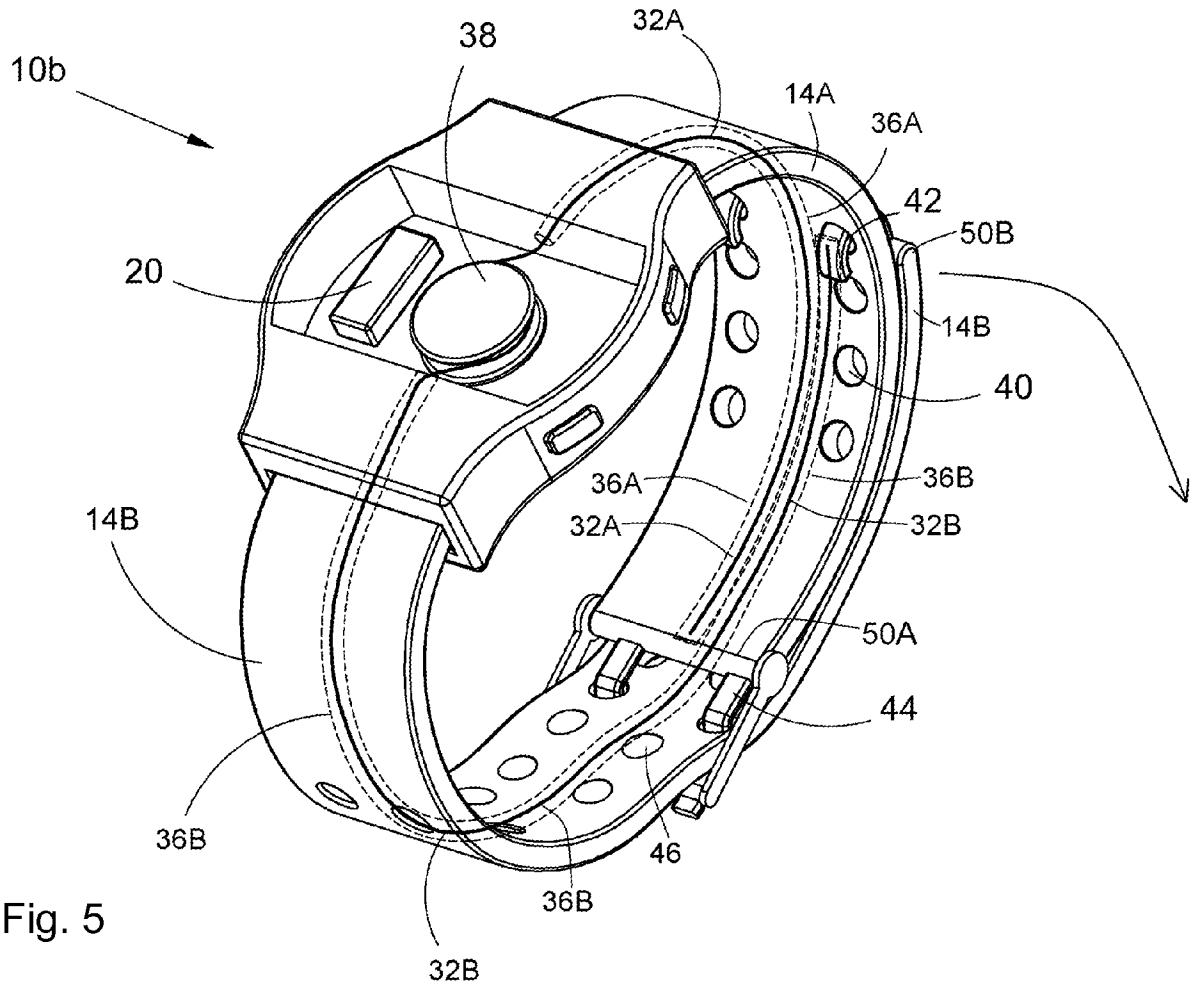
FIG. 5 schematically illustrates an alarm wristwatch, according to another embodiment of the invention.

FIG. 5 schematically illustrates an alarm wristwatch, according to another embodiment of the invention.

The wristwatch according to this embodiment of the invention is marked herein by reference numeral 10*b*.

FIG. 5 schematically illustrates the mechanism for changing the extent of strap 14 of the wristwatch of FIG. 5.

The mechanism for increasing and decreasing the extent of strap 14 may be applied to the common strap 14 consisting of two strap segments 14A and 14B, connected one to the other by a hook 44 of segment 14A inserted into a hole 46 of segment 14B.

Figure 6:
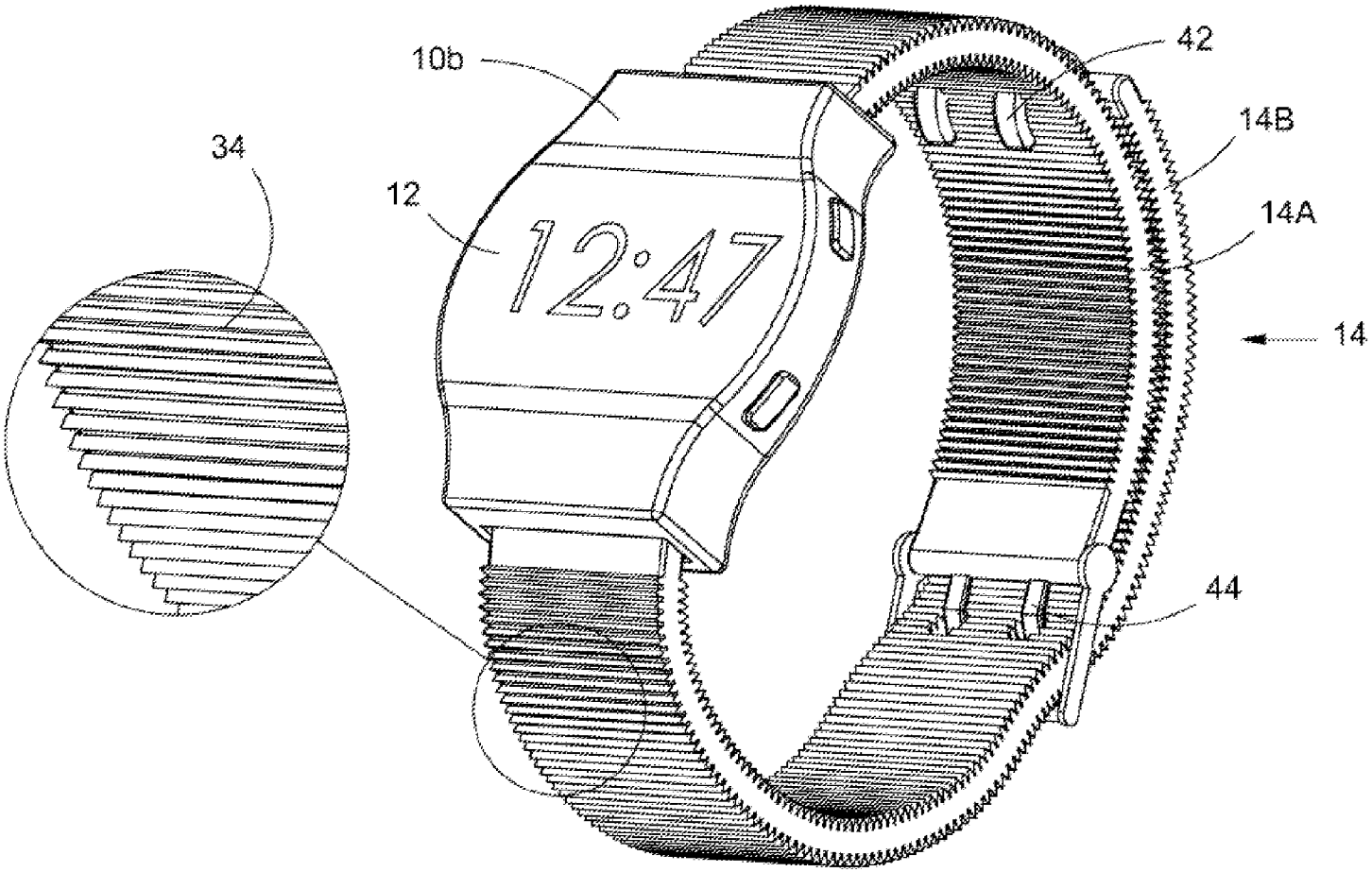
FIG. 6 depicts the shrunk state of the alarm wristwatch of FIG. 5.

FIG. 6 depicts the shrunk state of the alarm wristwatch of FIG. 5.

Once the mechanism decreases the extent of strap 14, strap 14 preferably shrinks evenly across the entire length thereof. In particular, the overlapping length of segments 14A and 14B shrink together, such that they are yet disposed attached one to the other.

Figure 7:
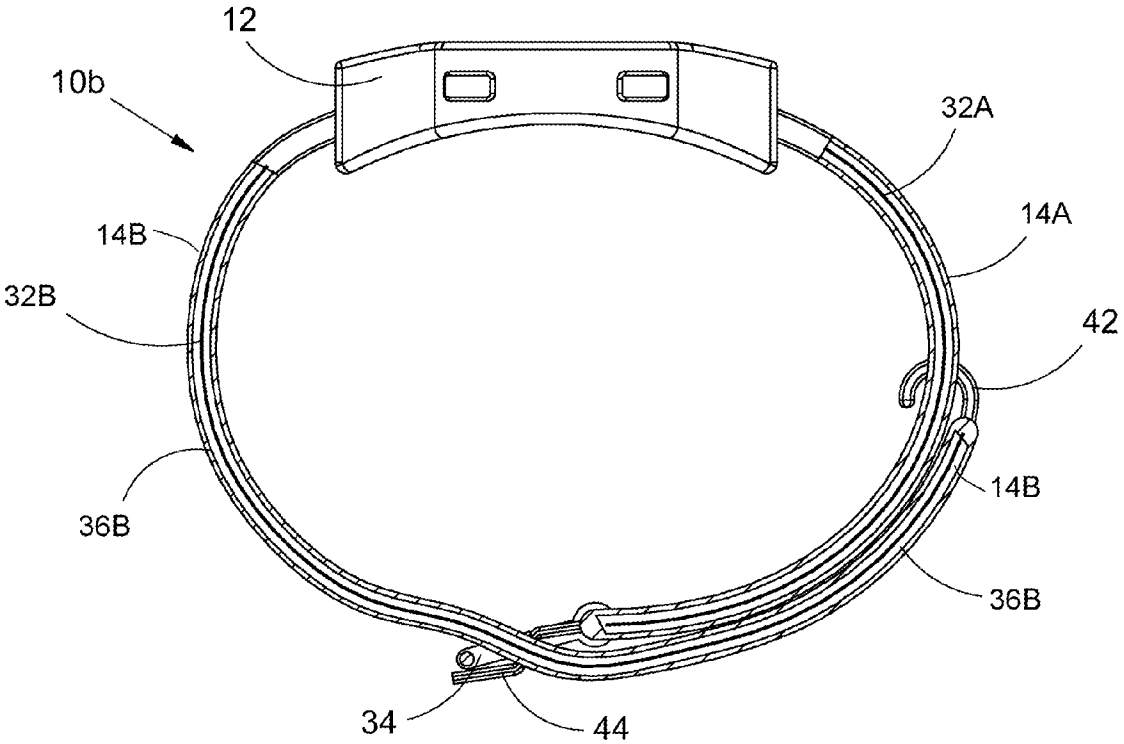
FIG. 7 is a sectional view of the mechanism for changing the extent of strap 14 of the wristwatch of FIG. 5.

FIG. 7 is a sectional view of the mechanism for changing the extent of strap 14 of the wristwatch of FIG. 5.

According to one embodiment of the invention, strap 14 is in a bellows form, as illustrated in FIG. 5.

According to another embodiment, each of segments 14A and 14B is shrinkable. A conduit 36A passes along strap 14A. A longitudinally non-elastic wire 32A passes in conduit 36A therealong. A conduit 36B passes along strap 14B. A longitudinally non-elastic wire 32B passes in conduit 36B therealong.

Each of wires 32A and 32B is wrapped around a pulley 38. Thus, the extent of each of segments 14A and 14B increases as pulley 38 rotates in one direction, and decreases as the pulley rotates in the opposite direction.

According to another embodiment, only one of the segments 14A or 14B includes the wire.

Segments 14A and 14B are connected one to the other by hook 44 located at the end of segment 14A, being inserted into hole 46 of segment 14B.

Segments 14A and 14B may further be connected one to the other by a hook 42 located at the end of segment 14B and inserted into a hole 40 of segment 14A. Hook 42 disallows drawing away of segment 14B from segment 14A, as depicted by the arrow.

The connection of segments 14A and 14B one to the other by hook 44 located at the end of segment 14A, and as well by hook 42 located at the end of segment 14B provides that the range between hook 44 and hook 42 forms a single band. Thus, segments 14A and 14B function as a single strap, for increasing and decreasing the extent thereof.

Figure 7A:
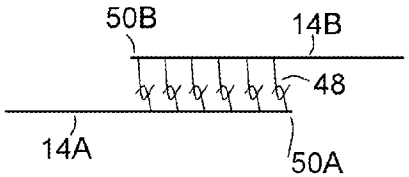
FIG. 7A depicts connection between the segments of FIG. 7, according to another embodiment.

FIG. 7A depicts connection between the segments of FIG. 7, according to another embodiment.

The term "overlapping length of the segments" refers herein to the length between the end 50A of segments 14A and end 50BB of 14B.

The connection of segments 14A and 14B one to the other between the end of segment 14A and the end of segment 14B may be obtained by other connection means, rather than by hooks 42 and 44, such as by hook and loop (Velcro) fastener 48, for connecting the significant overlapping length of the segments 14A and 14B.

The limitation may be against expanding the extent; however, the same mechanism can be applied for the opposite case, i.e., limiting the extent of the strap to a certain size.

Figure 8:
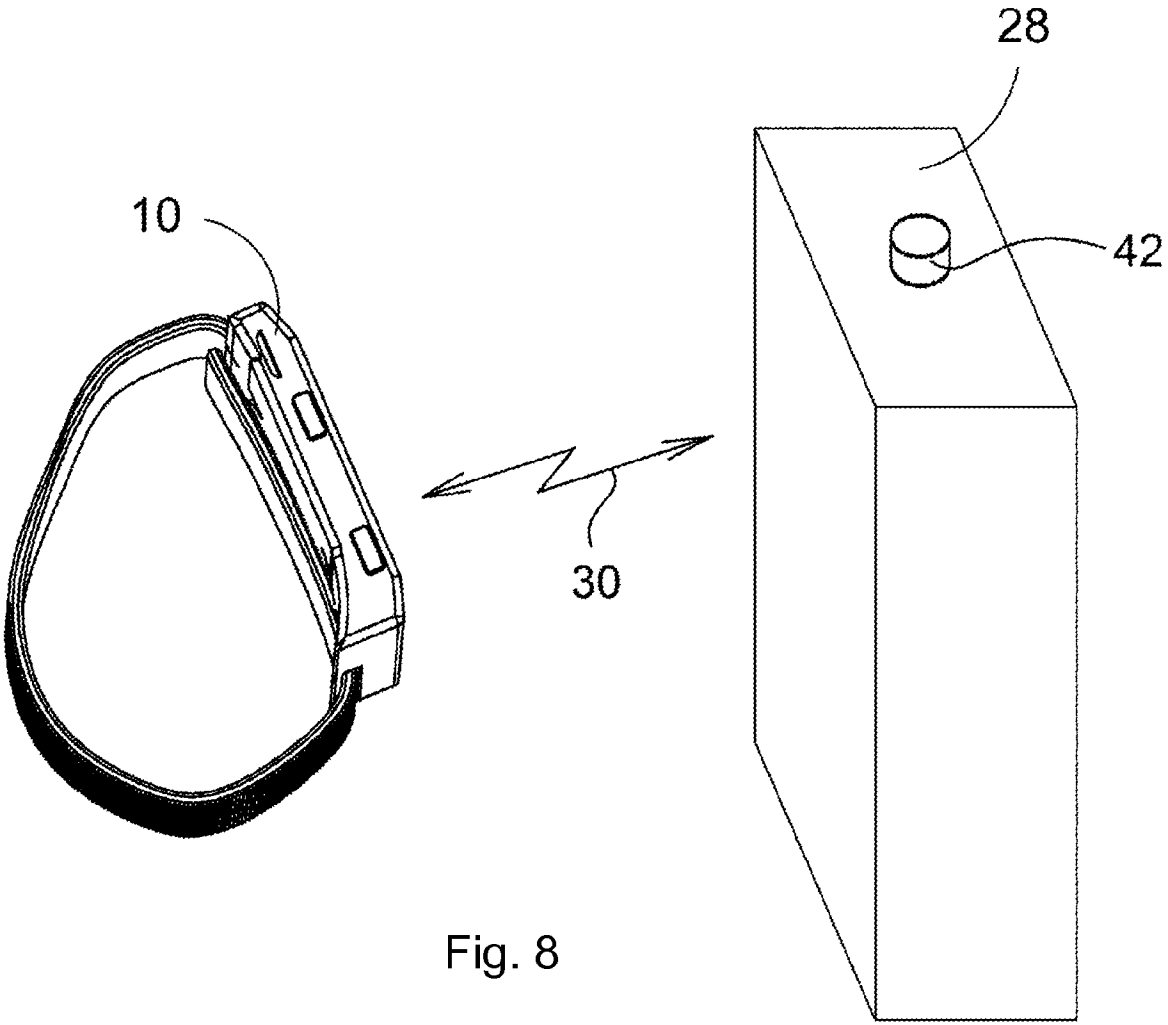
FIG. 8 illustrates a wristwatch 10 and an external device 28 communicating via a communication channel 30, according to one embodiment of the invention.

FIG. 8 illustrates a wristwatch 10 and an external device 28 communicating via a communication channel 30, according to one embodiment of the invention.

The communication channel may be wired (such as a USB communication) or wireless (such as Bluetooth communication).

The external device may be a computer, a smartphone, and so on, which provides a convenient user interface for setting the watch. For example, using these means, it is more convenient to set up the time of the watch, the alarming schedule, the format of the display of the watch, and so on, than the user interface that can be provided in a wristwatch, due to its "small" size.

According to one embodiment of the invention, the external device 28 is used for stopping an alarm. For example, assuming external device 28 is disposed distantly from wristwatch 10, when the alarm starts, the user has to reach the external device and press button 42, in order to stop the alarm. This may help to wake him better than pressing a corresponding button of the wristwatch.

Figure 9:
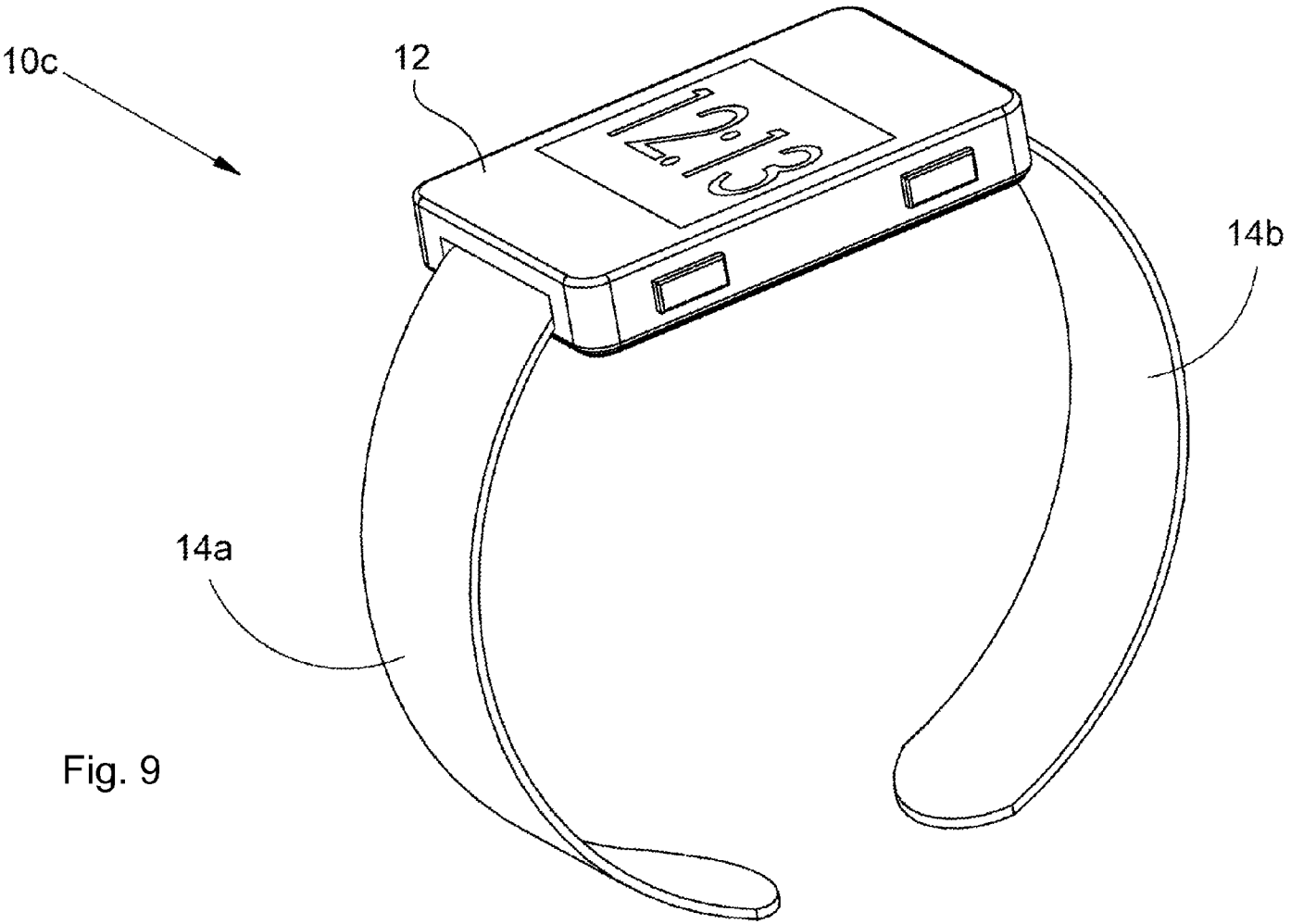
FIG. 9 schematically illustrates an alarm wristwatch, according to another embodiment of the invention.
Figure 10:
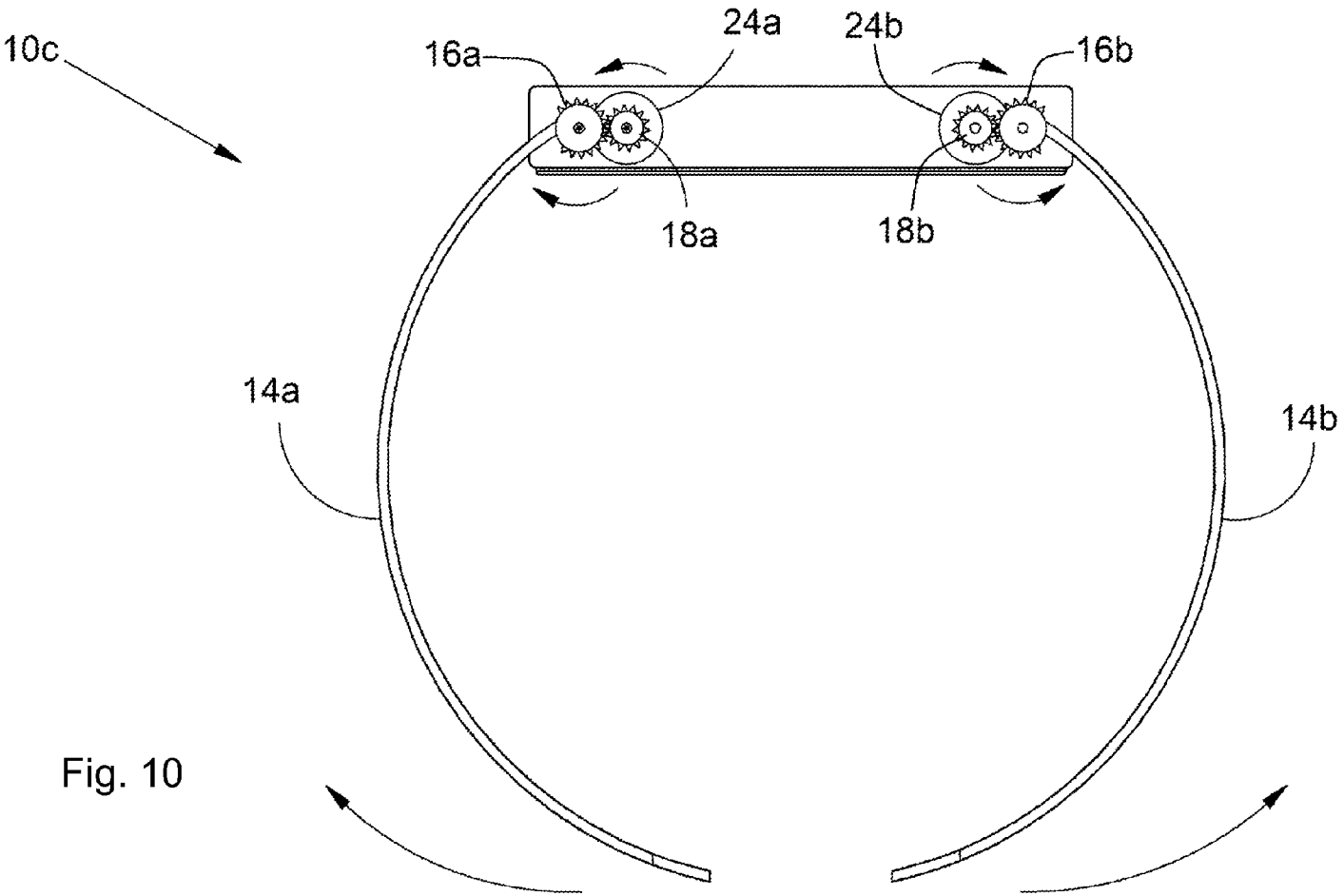
FIG. 10 is a sectional side-view of the alarm wristwatch.

FIG. 9 schematically illustrates an alarm wristwatch, according to another embodiment of the invention, and FIG. 10 is a sectional side-view thereof. The wristwatch of this embodiment of the invention is marked herein by reference numeral 10*c*.

According to this embodiment of the invention, the strap is divided into two rigid segments 14*a* and 14*b*. Each segment 14*a* and 14*b* is pivotally connected to watch 12 thereof. At the end of each segment 14*a* and 14*b* of the strap is disposed a cogged area 16*a* and 16*b* correspondingly, each in a form of a cogwheel. Two cogwheels 18*a* and 18*b* interlace with the cogged areas 16*a* and 16*b* correspondingly. The cogwheels are oppositely rotatable by a motor 24*a*, 24*b* correspondingly according to a command from a control circuitry (not seen in this figure) of the watch.

As cogwheels 18*a* and 18*b* rotate, segments 14*a* and 14*b* of the strap draw away each other, and as cogwheels 18*a* and 18*b* rotate in the opposite direction, segments 14*a* and 14*b* approach each other.

According to this embodiment of the invention, the alarming act is carried by repeatable drawing away/approaching the segments 14*a* and 14*b* each other.

In the figures and/or description herein, the following reference numerals (Reference Signs List) have been mentioned:

- each of numerals 10, 10*a* and 10*b* denotes a wristwatch, according to one embodiment of the invention;
- numeral 12 denotes a watch (mechanism and user interface);
- numeral 14 denotes a strap;
- numerals 14A and 14B denote two segments of a strap; according to one embodiment the segments are connected one to the other; according to another embodiment, the segments are rigid and are not connected one to the other;
- numeral 16 denotes a cogged area;
- numeral 18 denotes a cogwheel, in which the cogs thereof correspond to the cogged area 16 of strap 14;
- numeral 20 denotes a battery;
- numeral 22 denotes a control circuitry which controls the act of changing the extent of strap 14;
- numeral 24 denotes an electric motor;
- numeral 26 denotes a USB connector;
- numeral 28 denotes an external device to watch 12;
- numeral 30 denotes a communication channel between external device 28 and watch 12;
- numerals 32A and 32B denote longitudinally non-elastic wires passing through conduits 36A and 36B respectively;
- numeral 34 denotes a bellows surface;
- numerals 36A and 36B denote conduits disposed along strap 14;
- numeral 38 denotes a pulley around which wire 32A is wrapped;
- numeral 40 denotes a hole in strap 14;
- numeral 42 denotes a hook;
- numeral 44 denotes a hook;
- numeral 46 denotes a hole;
- numeral 48 denotes a hoop and loop fastener; and
- numerals 50A and 50B denote ends of the segments of the strap.

In the description herein, the following terms have been used:

- USB, the acronym of Universal Serial Bus;
- Bluetooth, a proprietary open wireless technology standard for exchanging data over short distances;
- CPU, the acronym of Central Processing Unit The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

The reference numbers in the claims are not a part of the claims, but rather used for facilitating the reading thereof. These reference numbers should not be interpreted as limiting the claims in any form.

What is claimed is:

1. An alarm wristwatch, comprising:

a watch;

a strap having an extent;

a mechanism for increasing and decreasing the extent of said strap; and a circuitry for controlling said mechanism to intermittently increase and decrease the extent of said strap, thereby increasing and decreasing a pressure of said strap on a user's wrist, resulting in attracting said user's attention while not attracting other persons' attention.

2. An alarm wristwatch according to claim 1, wherein said mechanism comprises:

a cogged area of said strap;

a cogwheel, correspondingly with said cogged area; and an electric motor, controlled by said circuitry, for rotating said cogwheel in one direction, thereby increasing said extent, and rotating said cogwheel in an opposite direction, thereby decreasing said extent.

3. An alarm wristwatch according to claim 1, wherein said mechanism comprises:

a conduit disposed along said strap;

a non-elastic wire disposed in said conduit; and a pulley wherein said wire is wrapped around, said pulley being controlled by said circuitry, for rotating said cogwheel in one direction, thereby increasing said extent, and rotating said cogwheel in an opposite direction, thereby decreasing said extent;

wherein said strap is characterized in allowing increasing and decreasing of the extent thereof.

4. An alarm wristwatch according to claim 1, wherein said strap comprises a first and a second segment.

5. An alarm wristwatch according to claim 4, wherein said first and second segments of said strap are connected one to the other at the overlapping length thereof, thereby said increasing and decreasing of the extent of said strap increases and decreases both of said segments together.

6. An alarm wristwatch according to claim 5, wherein the connection of said first and second segments of said strap one to the other at the overlapping length thereof comprises:

a first hook being located at an end of said first segment, for being inserted into a hole of said second segment; and a second hook being located at an end of said second segment, for being inserted into a hole of said first segment.

7. An alarm wristwatch according to claim 5, wherein the connection of said first and second segments of said strap one to the other at the overlapping length thereof comprises a hook and loop fastener.

8. An alarm wristwatch according to claim 1, further comprising an external device, in communication with said watch.

9. An alarm wristwatch according to claim 1, further comprising an external device, in communication with said watch, for stopping an alarm of said wristwatch.

10. An alarm wristwatch according to claim 1, further comprising an external device, in communication with said wristwatch, for providing a user interface for setting said wristwatch.

11. An alarm wristwatch according to claim 10, wherein said setting is selected from the group consisting of: a time, an alarming schedule, a display format of said wristwatch.

12. An alarm wristwatch according to claim 10, wherein said external device is a smartphone.

13. An alarm wristwatch according to claim 10, wherein said external device is a computer.

14. An alarm wristwatch according to claim 10, wherein said external device is a dedicated device.

15. An alarm wristwatch according to claim 1, wherein said circuitry is adapted to gradually intense a rhythm of said decreasing and increasing.

16. An alarm wristwatch according to claim 1, wherein said control circuitry is electronic.

17. An alarm wristwatch according to claim 1, wherein said control circuitry is computerized.

18. An alarm wristwatch according to claim 1, wherein said increasing and decreasing of the extent of said strap is carried out at one end of said strap.

19. An alarm wristwatch according to claim 1, wherein said increasing and decreasing of the extent of said strap is carried out at both ends of said strap.

20. An alarm wristwatch according to claim 1, wherein said mechanism comprises:

two rigid segments of said strap, pivotally connected to said watch;

each segment having a cogged area at the end thereof, in a form of a cogwheel;

each segment having a cogwheel, correspondingly with said cogged areas; and an electric motor, controlled by said circuitry, for generating an alarm by oppositely rotating said cogwheels in one direction, thereby drawing away said segments from each other, and rotating said cogwheels in an opposite direction, thereby approaching said segments to each other.

* * * * *